343-700 MS AU 251 EX

12/4/84 OR 4,486,758

United States Patent [19]

de Ronde

[11] Patent Number: 4,486,758

[45] Date of Patent: Dec. 4, 1984

[54] ANTENNA ELEMENT FOR CIRCULARLY POLARIZED HIGH-FREQUENCY SIGNALS

[75] Inventor: Frans C. de Ronde, Lesigny, France

[73] Assignee: U.S. Philips Corporation, New York, N.Y.

[21] Appl. No.: 372,365

[22] Filed: Apr. 27, 1982

[30] Foreign Application Priority Data

May 4, 1981 [FR] France ..... 81 08780

[51] Int. Cl.[3] ..... H01Q 1/38

[52] U.S. Cl. ..... 343/700 MS; 343/829; 343/768

[58] Field of Search ..... 343/700 MS, 829, 769, 343/768, 797, 798, 846, 767, 770, 830, 846–848

[56] References Cited

U.S. PATENT DOCUMENTS

| | | | |
|---|---|---|---|
| 2,947,987 | 8/1960 | Dodington | 343/769 |
| 2,977,595 | 3/1961 | Zisler et al. | 343/769 |
| 3,016,536 | 1/1962 | Fubini | 343/829 |
| 3,665,480 | 5/1972 | Fassett | 343/700 MS |
| 4,054,874 | 10/1977 | Oltman, Jr. | 343/700 MS |
| 4,063,246 | 12/1977 | Greiser | 343/700 MS |
| 4,130,822 | 12/1978 | Conroy | 343/700 MS |
| 4,170,013 | 10/1979 | Black | 343/700 MS |
| 4,208,660 | 6/1980 | McOwen, Jr. | 343/769 |
| 4,291,312 | 9/1981 | Kaloi | 343/829 |
| 4,369,447 | 1/1983 | Edney | 343/700 MS |

*Primary Examiner*—Eli Lieberman
*Assistant Examiner*—Michael C. Wimer
*Attorney, Agent, or Firm*—Robert J. Kraus

[57] ABSTRACT

An antenna element for coupling circularly-polarized radiation to a feedline. The element includes a pair of superposed planar dielectric layers. An outer surface of each layer is covered with an electrically-conductive layer forming a ground plane and having a circular opening defining respective cavities. Orthogonally-crossed dipoles are disposed between the dielectric layers and adjacent the openings for coupling radiation to the feedline through striplines also disposed between the dielectric layers.

15 Claims, 6 Drawing Figures

ANTENNA ELEMENT FOR CIRCULARLY POLARIZED HIGH-FREQUENCY SIGNALS

BACKGROUND OF THE INVENTION

The present invention relates to a receiving element for circularly polarized high-frequency signals realized in a planar structure in accordance with the printed circuit technology on a dielectric support, as well as to a planar antenna comprising a network of elements of this type. Obviously, in view of the reciprocity character of an antenna, a receiving element (or an antenna formed by a network of receiving elements) is capable of functioning as a radiating element (radiating antenna) without any modification of its characteristics. This remark holds without any exception throughout the following description, and the word "receiving" can at all times be replaced by the word "transmission".

U.S. Pat. No. 4,054,874, filed on June 11, 1975 and issued on Oct. 18, 1977 to Hughes Aircraft Company, discloses, among other embodiments, a high-frequency antenna formed from elements by means of which circularly polarized signals can be transmitted or received. Each element is assembled from a pair of conducting dipoles which are joined in a cross-wise configuration by means of their central portions to constitute one single device, coupled to the ends of corresponding transmission lines. The lengths of the transmission lines differ by one-quarter of the wavelength associated with the frequency of the transmitted or received signals in order that these useful signals are in phase quadrature.

Such a structure has unfortunately the following disadvantages. On the one hand its electrical asymmetry, predominantly owing to the non-symmetrical excitation (at one single end), causes the existence in the centre of the cross of a critical conductive coupling precisely where the current values are at their maximum, on the other hand the proposed antenna can only receive left-hand circularly polarized signals or right-hand circularly polarized signals (the existance of one of these two possibilities excludes the existence of the other possibility), this polarizing direction being fixed by the direction of polarization of the transmission lines coupled to that dipole which is the longer of the two.

SUMMARY OF THE INVENTION

It is an object of the invention to provide a novel receiving element structure for high-frequency signals, which does not discriminate between left-hand circular polarization or right-hand circular polarization, as well as to provide an antenna formed by such elements.

To this effect, the invention relates first of all to an element for receiving circularly polarized high-frequency signals, produced in a planar structure in accordance with the printed circuit technology on a dielectric support, or, in accordance with the reciprocity principle of antennas, to a radiating element for such signals realized in a similar manner, characterized in that it comprises the following symmetrical structure:

(A) two superposed planar dielectric layers, each layer having on its outer surface an electrically conductive surface forming a plane, commonly referred to as a ground plane, and having in each of these conducting surfaces a non-conducting cavity exposing the corresponding dielectric layer, these two cavities facing each other;

(B) in the median plane between the two layers, two distinct striplines for high-frequency transmission, a first end of each of these lines being adequately situated opposite the two cavities to realize a coupling with them which enables the transmission of high-frequency signals to be received, these two striplines being respectively disposed along two substantially perpendicular longitudinal axes whose point of intersection substantially coincides with the centre of the cavities, and the second end of each line forming a connection intended to be connected to electronic circuits of a receiving apparatus.

In a further embodiment of the invention, the receiving element also comprises in the same median plane at least two dipoles each formed by an electrically conductive strip of a length which is substantially equal to half the wavelength of the signals to be received. The dipoles are disposed to enable effective coupling between the dipoles and the corresponding transmission striplines. An insulating sheet is provided between the dipoles to electrically separate from each other at least those portions of the dipoles which are facing each other. The dipoles are located opposite the cavities.

Whatever the embodiment opted for, both these structures have the same essential advantages, namely the possibility of receiving both left-hand and right-hand circularly polarized signals, and the substantially total absence of coupling between the circuits which receive these two types of received signals. In the center of the dipoles the coupling is only capacitive, and the electric field is zero or very weak.

The invention also relates to an antenna comprising a network of receiving elements as defined in the foregoing, and having the following symmetrical structure:

(A) in a median plane, an assembly of $(m \times n)$ pairs of dipoles divided into first and second dipoles disposed respectively in accordance with two substantially perpendicular axes, the first dipoles on the one hand, and the second dipoles on the other hand being arranged in parallel with each other in each pair of dipoles;

(B) in the median plane, two distinct planar networks of high-frequency transmission striplines each formed by a sequence of combining stages for the received signals, the $(m \times n)$ ends of each network being located opposite one end of the $(m \times n)$ first dipoles for one of the networks and one end $(m \times n)$ of the second dipoles for the other network so as to realize an adequate capacitive coupling between each dipole and the $(m \times n)$ dipoles associated therewith to enable the transmission of the high-frequency signals to be received, and the opposite end of each of these two networks forming a connection intended to be connected to the electronic circuit of the receiving apparatus;

(C) on both sides of this same median plane, two dielectric planar layers each comprising on its exterior surface an electrically conducting surface forming a plane commonly referred to as a ground plane, and, in each of these conducting surfaces $(m \times n)$ non-conducting cavities exposing the corresponding dielectric layer and situated opposite the $(m \times n)$ pairs of dipoles.

A stripline antenna is already disclosed in the U.S. Pat. No. 4,170,013, filed on July 28, 1978 and issued on Oct. 2, 1979 to the United States of America, represented by the Secretary of the Navy, but the antenna disclosed there can in no circumstances be used, in contrast with the embodiment of the antenna described above, for receiving high-frequency signals which may be at the same time subjected to left-hand or right-hand circular polarization. Furthermore, the receiving elements of the antenna described in said patent are assembled from magnetic dipole elements instead of electric dipole elements.

BRIEF DESCRIPTION OF THE DRAWING

Further particulars and advantages of the elements and antennas realized in accordance with the invention will be apparent from the following description which is given by way of non-limitative example with reference to the accompanying drawing in which:

FIG. 3*a* is a top view of a planar antenna comprising a receiving element network in accordance with the invention and FIG. 3*b* shows a cross-sectional view along the axes bb of FIG. 3*a.

DESCRIPTION OF THE PREFERRED EMBODIMENTS

Figure 1A:
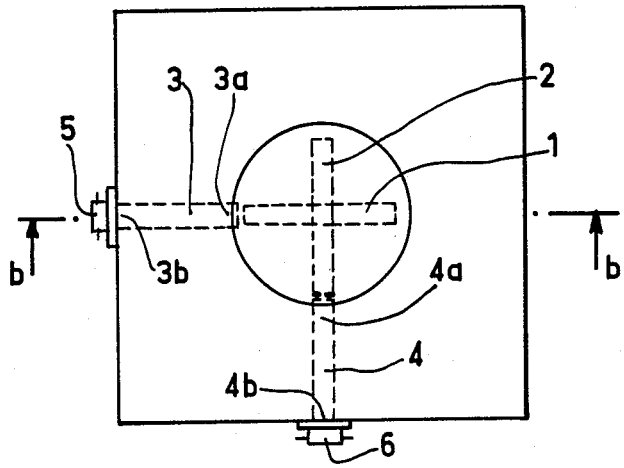
FIG. 1*a* is a top view of a receiving element in accordance with the invention and FIG. 1*b* is a cross-sectional view along the axes bb of FIG. 1*a;*
Figure 1B:
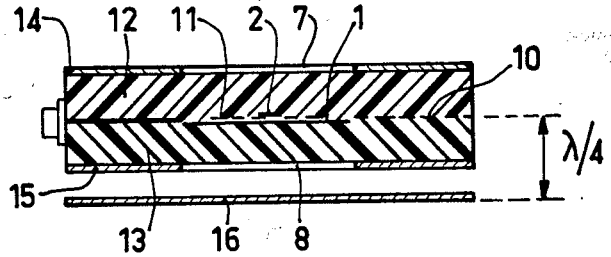

The receiving element shown in FIGS. 1*a* and 1*b* is produced in accordance with the printed circuit technology on a dielectric support and has the following plane-symmetrical structure. A first plane 10, commonly referred to as the median plane, forms a symmetry plane for the described structure and separates two dipoles 1 and 2. Each dipole consists of an electrically conducting strip whose length is substantially equal to half the wavelength of the high-frequency signal before reception. These dipoles 1 and 2 are here arranged such that they form an electrically symmetrical cross along two perpendicular axes, and are separated by a thin insulating sheet 11. The dimensions of this sheet may, if so desired, be limited to the dimensions necessary to insulate the two portions of the dipoles which are actually opposite to each other from each other.

This same median plane 10 also contains two striplines 3 and 4, which are intended to ensure the transmission of the signals received by the dipoles to a receiving apparatus, not shown. These two striplines 3 and 4 may be independent, without any electric connection between them. A first end 3*a* of the line 3 is located opposite a cavity of the dipole 1 and is aligned therewith so as to realize with this dipole a capacitive coupling and, in a similar way a first end 4*a* of the line 4 is located opposite an end of the dipole 2 and is aligned therewith so as to realize also a capacitive coupling. The two ends 3*b* and 4*b* of the line 3 and the line 4 are provided with connectors 5 and 6, respectively, and each constitutes a connection intended to be connected to electronic receiving circuits, not shown.

To complete this structure, the receiving element finally comprises, on both sides of the median plane 10, two dielectric planar layers 12 and 13, comprising on their outer surfaces electrically-conducting surfaces, 14 and 15, respectively which form a ground planes. In these conducting surfaces, non-conducting cavities 7 and 8, respectively have been provided, the cavity 7 exposing in the surface 14 the dielectric layer 12 and the cavity 8 exposing in the layer 15 the dielectric layer 13. The cavities 7 and 8 are circular, and have a diameter which is somewhat greater than the length of each dipole, and are located opposite the dipoles in such a manner that these dipoles are wholly contained in the cylindrical contour defined by these cavities.

The element proposed is interesting in several respects: (a) the coupling of line dipoles and space dipoles may simultaneously be strong, thanks to the presence of the ground planes preventing parasitic radiation from the transmission striplines and the presence of the cavities ensuring reception only opposite the dipoles; (b) both left-hand and right-hand circularly polarized signals are received, as the proposed structure does not exclude either of the two possibilities, the separation between them not being effected until afterwards; (c) the coexistence of these two possibilities to receive differently circularly polarized signals is accompanied by a good electrical insulation between the corresponding circuits, owing to the complete separation of the two dipoles 1 and 2 (in contrast with what is described in the above-mentioned U.S. Pat. No. 4,054,874).

The element may have a metallic reflecting surface 16, provided at one side of the element (see FIG. 1*b*) and in parallel with the median plane 10. Such a characteristic renders it possible to increase the receiving efficiency, the received waves which reach the surface 16 being conveyed to the dipoles. To ensure that this increase is optimum, it is necessary for the distance between this surface 16 and the median plane 10 to be equal or substantially equal to one-quarter wavelength of the frequency of the usual signals to be received. (Equal must here be understood to mean electrically equivalent, taking into account the media passed through. Between the surface 16 and the plane 10 there is actually a layer of air and a dielectric layer, the layer 13).

Following are examples of various adaptations of the element:

(a) If the strips which form the dipoles have different lengths, the dipoles can receive the signals of different frequencies corresponding to their respective lengths.

(b) If the ends of the strips are given a width which is greater than the width of their central zone, each dipole may either ensure the reception of signals having the same frequencies but with somewhat smaller dimensions compared with the case in which the width of each dipole remains constant, or, when the dimensions are kept equal to ensure the reception of signals having lower frequencies.

Figure 2:
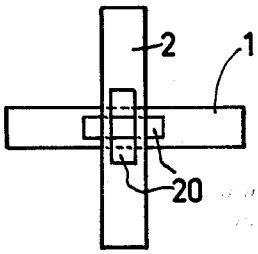
FIG. 2 shows two dipoles in which non-conducting cavities 20 have been provided around the point of intersection of the longitudinal axes.

(c) Finally, it is possible to increase the almost total absence of coupling between the dipoles by (1) arranging them with respect to each other in such a way that the intersection of the two perpendicular axes along which they are placed coincide, for each dipole, with its electrical minimum, or (2) providing (see FIG. 2) a small non-conducting cavity 20 in each dipole around the point which corresponds to the intersection of these two axes (by reducing any residual coupling between the dipoles, the cavities render it possible to make the insulating sheet 11 still thinner. Too great a width of this sheet might disturb the symmetry of the structure of the receiving element and reduce its advantages), or (3) combining these two measures.

Figure 3A:
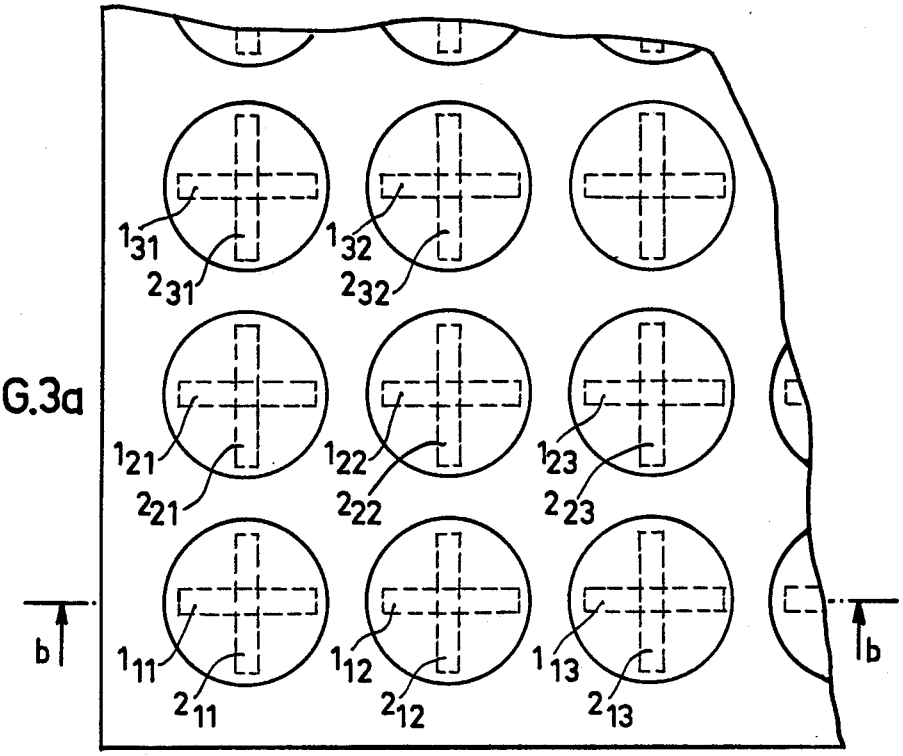
Figure 3B:
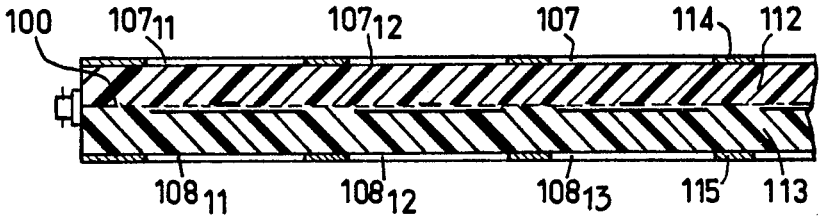

The above-described element may, in accordance with the invention, be used to realize a high-frequency planar antenna formed by a whole network of such elements in accordance with the same printed circuit technology on a dielectric support, having the structure described hereinafter with reference to FIGS. 3*a* and 3*b*.

In a first median plane 100 there is provided an assembly of (m×n) pairs of dipoles $\mathbf{1}_{m,n}$ and $\mathbf{2}_{m,n}$. The dipoles have been given the same references as the dipoles 1 and 2 of the individually considered element, but with the indices m, n to distinguish them individually. In the example considered here, m and n are each equal to 25 but they may of course have other values. In each pair, the dipoles $\mathbf{1}_{m,n}$ and $\mathbf{2}_{m,n}$ are, as in the foregoing, arranged as an electrically symmetrical cross, along two perpendicular axes, and are completely separated from each other by an electrical insulation which is in the form of an insulating sheet. Either one single sheet having the same surface area as the whole antenna or pieces of insulating sheets which are only provided in the region of the dipoles, may be used. It is possible that the pieces are limited to dimensions which are just sufficient to ensure that the portions of the dipoles which are opposite each other are effectively insulated from each other.

The 2.(m×n) dipoles ($\mathbf{1}_{m,n}$), ($\mathbf{2}_{m,n}$) are each formed by a conducting strip whose electrical length is substantially equal to half the wavelength of the high-frequency signals to be received. For simplicity of the description of their arrangement, the dipoles are grouped in (m×n) first dipoles $\mathbf{1}_{m,n}$ and in (m×n) second dipoles $\mathbf{2}_{m,n}$, all the first dipoles being arranged in parallel with each other in each pair of dipoles, all the second dipoles also being arranged in parallel with each other in each pair of dipoles.

The median plane 100 further contains, in addition to the (m×n) pairs of dipoles, the combination of two networks of high-frequency transmission striplines, not shown in the Figures for the sake of simplicity. These networks, just as the lines 3 and 4, are electrically independent of each other and intended to ensure the transmission of the signals received by the dipoles to the receiving apparatus (not shown), and to this end they are each formed by a sequence of combining stages for the received signals. There are numerous embodiments of such networks (See, by way of non-limitative example, the network represented in FIG. 1 of French Patent Specification No. 70 11 449, corresponding to U.S. Pat. No. 3,587,110). The (m×n) first ends of one of the networks are situated opposite an end of the (m×n) dipoles $\mathbf{1}_{m,n}$ (the same holds for all the dipoles) and are each aligned with the corresponding end of the dipoles, so as to realize a capacitive coupling by means of the dipoles concerned; similarly, the (m×n) first ends of the other network are situated opposite one end of the (m×n) dipoles $\mathbf{2}_{m,n}$ and aligned with them, respectively to also ensure a capacitive coupling of the dipoles to the network. The opposite end, or second end, of the first network is the point in which all the transmission lines forming this network converge; it is provided with a first connector and forms a connection intended to be connected to the electronic circuit of the receiving apparatus; the same holds for the second end of the second network, which is provided with a second connector.

To complete the structure, the antenna finally comprises, on either side of the median plane 100, two planar dielectric layers 112 and 113 each comprising on its exterior surface an electrically conducting surface, 114 and 115, respectively, which constitutes a ground plane. These conducting surfaces 114 and 115 each comprise an assembly of (m×n) non-conducting cavities exposing the corresponding dielectric layer 112 or 113. These cavities $\mathbf{107}_{m,n}$ and $\mathbf{108}_{m,n}$ are circular, and have a diameter which is somewhat larger than the length of the dipoles and are situated with respect to these dipoles in such a manner that each pair of dipoles is wholly contained in the cylindrical contour defined by the corresponding cavities.

The antenna thus provided has the same advantages as the single element described in the foregoing (useful coupling quality, almost total absence of unwanted couplings, capability of simultaneously receiving left-hand and right-hand circularly polarized signals, variations in the characteristics of the dipoles, etc . . . ).

The present invention is of course not limited to the above-described embodiments, on the basis of which other variations may be proposed without departing from the scope of the invention.

Particularly, the element and the antenna as described in the foregoing comprise dipoles, but an embodiment without dipoles (all the other things remaining substantially the same) may be proposed with the same essential advantages as described above. In this case the dimensions of the cavities are such that they become resonant diaphragms for the frequency of the signals to be received, the strength of the coupling between the diaphragms and the striplines then being determined by the degree of penetration of the ends of these lines in the cylindrical contour which is defined by the cavities.

On the other hand, when the dipoles are provided, their inclination between the pairs remains similar, but may be chosen in several different manners, one of the most interesting orientations being the orientation in which the dipoles are inclined by 45°, which renders a symmetrical arrangement of the first and second networks of the striplines possible.

Figure 4:
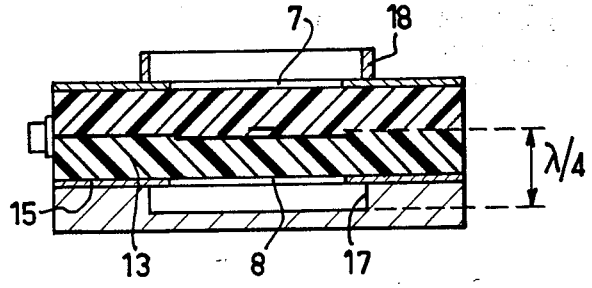
* and FIG. 4 shows a variation of the embodiment of the receiving element in accordance with the invention.

If the element or the antenna in accordance with the invention is provided with a metallic reflecting surface such as 16 (see the element of FIG. 1*b*), this surface may be limited, particularly to avoid any coupling between adjacent receiving elements, by (m×n) lateral metallic partitions which have a diameter which is slightly greater than the diameter of the cavities. These partitions are arranged perpendicularly to the reflecting surface, which now constitutes a bottom partition, and are placed in the ground plane of the corresponding dielectric layer (see FIG. 4 which shows an element provided with such a partition 17). The element or the antenna may alternatively be provided, particularly to avoid any horizontal radiation from one receiving element to the other, with a metallic collar 18 having a diameter which is identical to the diameter of the partition 17 and being placed in the ground plane of the other dielectric layer.

Whatever the embodiment, the element and the antenna described in the foregoing find an essential use in the field of satellite television, for apparatus in receiving systems for these television signals.

What is claimed is:

1. An antenna element for coupling circularly-polarized radiation to a feedline, said element comprising:

(a) first and second superposed planar dielectric layers;

(b) first and second conductive layers on outer surfaces of the first and second dielectric layers, respectively, at least one of said conductive layers having therein an opening exposing a portion of the outer surface of the respective dielectric layer and defining a cavity in the antenna element;

(c) first and second orthogonally-crossed conductive strip dipoles disposed between the dielectric layers under the exposed portion of the outer surface, said dipoles being electrically insulated from each other and each having a length approximately equal to one-half of the wavelength of radiation to be coupled thereby; and (d) first and second conductive strips disposed between the dielectric layers and being longitudinally aligned with the first and second dipoles, respectively, each of said conductive strips having one end coupled to its respective dipole and having another end coupled to the feedline.

2. An antenna element as in claim 1 including a metallic reflector spaced from and parallel to the conductive layer having the opening.

3. An antenna element as in claim 2 where the spacing between the metallic reflector and the dipoles is approximately one-quarter of the wavelength of the radiation to be coupled by at least one of said dipoles.

4. An antenna element as in claim 1, 2 or 3 where the opening in the conductive layer is circular and has a diameter approximately equal to one-half of the wavelength of the radiation to be coupled by at least one of the dipoles.

5. An antenna element as in claim 1, 2 or 3 where the conductive strip dipoles have different lengths.

6. An antenna element as in claim 1, 2 or 3 where the conductive strip dipoles are wider at their ends than in their centers.

7. An antenna element as in claim 1, 2 or 3 where at least one of said conductive strip dipoles has an opening in a region thereof which crosses over the other conductive strip dipole.

8. An antenna element for coupling circularly polarized radiation to a feedline, said element comprising:

(a) first and second superposed planar dielectric layers;

(b) first and second conductive layers on outer surfaces of the first and second dielectric layers, respectively, each of said conductive layers having therein an opening exposing a portion of the outer surface of the respective dielectric layer, said openings defining opposite ends of a cylindrical dielectric region within the antenna element;

(c) first and second orthogonally-crossed conductive strip dipoles disposed between the dielectric layers and contained within the cylindrical dielectric region, said dipoles being electrically insulated from each other and having a length approximately equal to one-half of the wavelength of radiation to be coupled thereby; and (d) first and second conductive strips disposed between the dielectric layers and being longitudinally aligned with the first and second dipoles, respectively, each of said conductive strips having one end coupled to its respective dipole and having another end coupled to the feedline.

9. An antenna element as in claim 8 including a metallic reflector spaced from and parallel to at least one of said conductive layers.

10. An antenna element as in claim 9 where the spacing between the metallic reflector and the dipoles is approximately one-quarter of the wavelength of the radiation to be coupled by at least one of said dipoles.

11. An antenna element as in claim 8, 9 or 10 where the conductive strip dipoles each have an opening in a region thereof which crosses over the other conductive strip dipole.

12. An antenna for coupling circularly-polarized radiation to a plurality of feedlines, said antenna comprising:

(a) first and second superposed planar dielectric layers;

(b) first and second conductive layers on outer surfaces of the first and second dielectric layers, respectively, at least said first conductive layer having therein a plurality of openings exposing portions of the outer surface of the respective dielectric layer and defining a plurality of cavities in the antenna element;

(c) first and second orthogonally crossed conductive strip dipoles disposed between the dielectric layers under each of the exposed portions of the outer surface, said first and second dipoles being electrically insulated from each other and each having a length approximately equal to one-half of the wavelength of radiation to be coupled thereby; and (d) for each first and second dipole, respective first and second conductive strips disposed between the dielectric layers, each conductive strip being longitudinally aligned with and having one end coupled to the respective dipole and having another end thereof coupled to one of the feedlines.

13. An antenna as in claim 12 where all of the first conductive strip dipoles are parallel to each other and where all of the second conductive strip dipoles are parallel to each other.

14. An antenna as in claim 12 or 13 including a plurality of metallic reflectors, each spaced from and parallel to one of the exposed portions of the outer surface of the first dielectric layer, and a corresponding plurality of partitions surrounding the openings exposing said portions and extending from the respective conductive layer.

15. An antenna as in claim 14 where both of the conductive layers have said openings and including a plurality of metallic collars surrounding the openings in the second conductive layer and extending from said conductive layer.

* * * * *